US011892260B2

(12) United States Patent
Markut et al.

(10) Patent No.: US 11,892,260 B2
(45) Date of Patent: Feb. 6, 2024

(54) HANDGUARD FOR CLAMPING MOUNTING ON AN EXISTING FIREARM

(71) Applicant: GLOCK TECHNOLOGY GMBH, Ferlach (AT)

(72) Inventors: Karl Markut, Klagenfurt (AT); Patrick Nolte, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 78 days.

(21) Appl. No.: 17/757,291

(22) PCT Filed: Nov. 23, 2020

(86) PCT No.: PCT/EP2020/083075
§ 371 (c)(1),
(2) Date: Jun. 13, 2022

(87) PCT Pub. No.: WO2021/121877
PCT Pub. Date: Jun. 24, 2021

(65) Prior Publication Data

US 2023/0020437 A1 Jan. 19, 2023

(30) Foreign Application Priority Data

Dec. 17, 2019 (EP) ..... 19216891

(51) Int. Cl.
*F41C 23/16* (2006.01)
*F41A 21/32* (2006.01)
(Continued)

(52) U.S. Cl.
CPC ..... *F41A 21/325* (2013.01); *F41A 21/30* (2013.01); *F41A 21/481* (2013.01);
(Continued)

(58) Field of Classification Search
CPC ..... F41C 23/16
See application file for complete search history.

(56) References Cited

U.S. PATENT DOCUMENTS 7,523,580 B1 4/2009 Tankersley
8,931,196 B1 * 1/2015 Larue ..... F41A 11/04 42/75.01

(Continued)

FOREIGN PATENT DOCUMENTS

WO 2013010516 A1 1/2013

OTHER PUBLICATIONS

International Search Report for PCT/EP2020/083075, dated Jan. 29, 2021.

*Primary Examiner* — J. Woodrow Eldred
(74) *Attorney, Agent, or Firm* — Raven Patents, LLC; Anton E. Skaugset

(57) ABSTRACT

A handguard for mounting on a firearm with a housing axis, including: a housing with a slit and with a clamping device including a lever with a center element which lies in a normal plane to the housing axis in a through-opening. It has a recess in its central region, a thread at one end, a lever arm at the other end, and a nut with an internal thread. According to the invention, the center element has a conical nut section. In the assembled state, a nut is screwed onto the thread and thus the center element is arranged in an annular groove of the travelling nut so as to make contact with the center element.

3 Claims, 7 Drawing Sheets

(51) Int. Cl.
*F41A 21/30* (2006.01)
*F41A 21/48* (2006.01)

(52) U.S. Cl.
CPC ..... *F41A 21/484* (2013.01); *F41A 21/485* (2013.01); *F41C 23/16* (2013.01)

(56) References Cited

U.S. PATENT DOCUMENTS

| | | | | |
|---|---|---|---|---|
| 9,032,658 | B2 | 5/2015 | Geissele | |
| 10,436,549 | B1 | 10/2019 | Taylor et al. | |
| 10,775,129 | B1 * | 9/2020 | Kincel | F41C 23/16 |
| 2015/0377584 | A1 * | 12/2015 | Chvala | F41C 23/16<br>42/75.01 |
| 2019/0162503 | A1 * | 5/2019 | Keeney | F41C 27/00 |
| 2019/0170476 | A1 | 6/2019 | Hiler, Jr. et al. | |

* cited by examiner

II-II'

HANDGUARD FOR CLAMPING MOUNTING ON AN EXISTING FIREARM

TECHNICAL FIELD

The present disclosure relates to firearms, and more particularly to a handguard for clamping mounting on an existing firearm.

BACKGROUND

The publication WO 2013/010516 A1 discloses an arrangement to exchange and lock the barrel of a long gun with a handguard which is elastically deformed by a bolt and nut device, which is oriented perpendicular to the center plane of the gun and has cam-like surfaces which co-operate with the surface of the handguard. When threaded into one another, the cam-like surfaces press the handguard towards the center plane and fix it on the weapon. The device consists of a plurality of small parts and has to be demounted totally in order to change the handguard; the threads are in danger to get dirty or otherwise compromised.

Similar devices are known from the U.S. Pat. No. 10,436,549 B1, the US 2019/0170476 A1 and the U.S. Pat. No. 7,523,580 B1. The contents of these documents, as well as the contents of the U.S. Pat. No. 7,538,580 B1 and the U.S. Pat. No. 9,032,658 B2, mentioned below, are incorporated by reference into this application and description for all jurisdictions where this is possible.

For numerous rifles (carbines), in particular those of the types mentioned, handguards (also often referred as forearms) have been known for many years as independent parts and are available on the market, which fulfill the most varied wishes. It is therefore assumed as a given present disclosure relates to a handguard adapted to a firearm, which thus geometrically and functionally fits the weapon, so that it can be used with the handguard according to the disclosure. As a general technological background, the following can be briefly stated:

On the one hand, handguards form a grip area for the free hand—the target hand—of the shooter and allow the user to grip the firearm without directly contacting the barrel, which becomes hot during use. On the other hand, a handguard protects the barrel from blows, dirt, etc. and can be used as a mount for a variety of accessories, such as rifle scopes, residual light amplifiers, flashlights, laser pointers, and much more.

The handguard can be understood as a kind of extension of the housing of a rifle in the barrel direction. In order to improve the precision of a rifle, the handguard must therefore be connected to the case as rigidly as possible relative to the barrel and therefore also relative to the housing. However, the barrel must be able to swing "freely" when the shot is fired.

The barrel is usually fastened to the housing by means of a travelling nut, which is usually designed as a union nut and bolted to the housing. The travelling nut presses the barrel against a radially projecting shoulder of the housing.

From the prior art, a number of possibilities to couple a handguard to the housing are known for AR-15-type rifles, whereby very often a circumferential clamping, i.e. tangential to the axis of the handguard, is carried out, which in the following, if nothing else results from the context, is also referred to as the reference axis when the term "axial direction" is used. In most cases, a bracing against the barrel direction, i.e. against the upper housing, is realized by means of a separate, second clamping device of its own.

The desire remains for quick disassembly/assembly of the handguard, whether in use or for maintenance purposes. Furthermore, the disassembly and assembly process should be able to be carried out as simply as possible. Special tools are often required, which of course have to be carried separately. Often, as shown in U.S. Pat. No. 9,032,658 B2, for example, the tangential clamping is done by screws, which clamp the handguard tangentially to the travelling nut. There, an additional locking against shifting of the handguard in the axial direction is achieved by partial engagement of the screws in the grooves of the travelling nut provided for this purpose.

U.S. Pat. No. 7,538,580 B1 follows a similar approach, which prevents the handguard from being displaced in the axial direction by a tangentially displaceable locking bolt.

As a rule, a number of components are required to form a clamping at least in the tangential direction. Securing and pretensioning the barrel in the axial direction, preferably also via a clamping device, would also be desirable in order to form as rigid a connection as possible between the housing and the handguard.

What is needed is a handguard clamping device, which secures the handguard against displacement relative to the housing and at the same time ensures a rigid connection to the housing. Such a clamping device should use as few components as possible, be easy to handle, easy to maintain and relatively simple in design.

SUMMARY

The present disclosure is directed to handguards for firearms, including rifles for mounting on a barrel or a barrel nut of an existing firearm, where the barrel or barrel nut has an annular groove. In one example the handguard includes a handguard housing having a housing axis, the handguard housing defining a slit running radially thereto, and further defining a through-opening running in a transverse direction, where the through-opening is a long hole having an outline comprised of two semicircles with a first axis and a second axis parallel to the first axis, with a rectangle located in-between; and a clamping device for mounting in the through-opening of the handguard housing. The clamping device in turn includes a lever that defines a lever axis and that includes a center element having a recess in a center area of the center element, the center element extending along and surrounding the lever axis and having a threaded section at a first end portion and a lever arm at a second end portion, where a conical shaft section is provided at the second end portion that widens towards the lever arm and is configured to contact a corresponding conical clamping surface of the handguard housing; and a nut having an internal thread that matches the threaded section of the first end portion of the center element; such that when the handguard is in its assembled state, the lever is disposed in the through-opening of the handguard housing in a plane normal to the handguard axis, the nut is screwed onto the threaded section thereby narrowing the slit, and an angular position of the lever about the lever axis is such that the center element contacts the annular groove of the barrel or barrel nut.

DETAILED DESCRIPTION

In the description and in the claims "before" or "in the front/forward" is used as the direction towards the muzzle of the barrel, "in the back/back" as the direction towards the stock, "down/downward" as the direction for the lock towards the magazine, and "up/upward" as the direction away from the magazine. The terms "center plane of the weapon," "barrel bore," "barrel axis," "barrel core," etc. have the usual meaning that the person skilled in the art attaches to them in the prior art. "Left" thus refers to the center plane of the weapon, "from left" corresponds to a movement, actuation, exertion of force in the direction of the center plane of the weapon, starting from a starting position to the "left" of it, etc. After a shot has been fired, the lock is moved "to the rear" under the effect of the gases and then "to the front" again under the effect of a closing spring, etc.

The present disclosure relates to a handguard for a rifle (or carbine), which may also be called handguard clamping or only clamping, especially for weapons of the rifle type M4/M16/AR15. The clamping device according to the disclosure and its variants are not limited to rifles, carbines, etc., but can also be adapted for use in pistols. The improvements provided by the handguards of the disclosure and their effects/advantages are listed below.

In the figures, everything that concerns the handguard 1 without the clamping device was marked with "1*n*," analogously, everything that concerns the clamping device 2 was marked with "2*n*."

FIGS. 1-6 show exemplary embodiments suitable for use in an AR15 or M4 rifle. Modifications of the examples shown can be easily and simply transferred to other types of rifles by the person skilled in the art with knowledge of the disclosure without extensive or complex tests.

Figure 1:
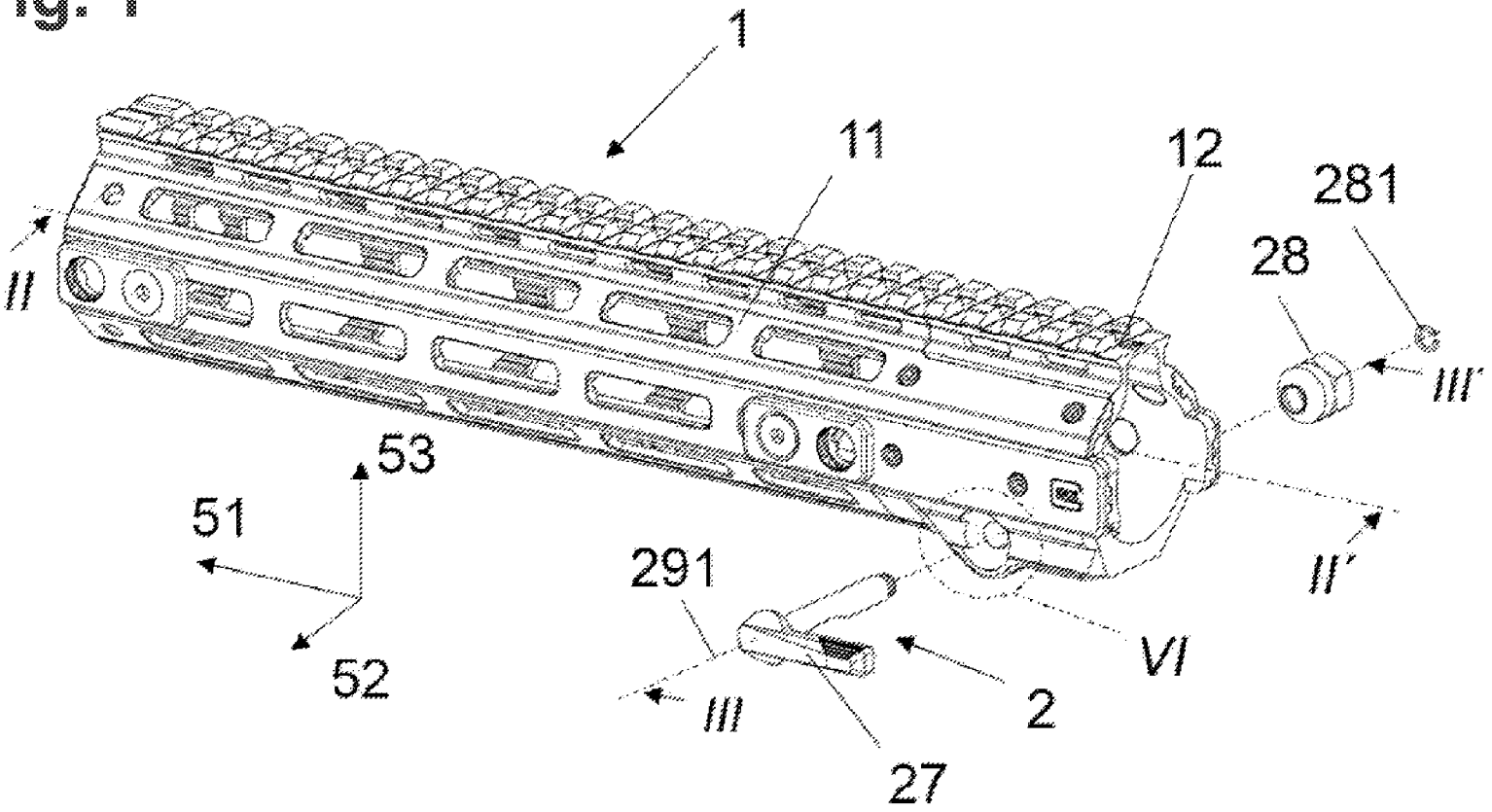
FIG. 1 is a schematic exploded view of an illustrative handguard according to the present disclosure.

FIG. 1 shows a schematic exploded view of a handguard 1 with housing 11 and built-in spacer 12, which is not essential for the purposes of the present disclosure and is therefore not further explained. Also shown is a clamping device 2 according to the present disclosure with a lever 21, a nut 28 and a locking ring 281; a coordinate system—barrel direction 51, shaft direction, forward; transverse direction 52 to the left and vertical 53 to the top—used in some instances in the description and in the claims, is drawn for better orientation.

Figure 2:
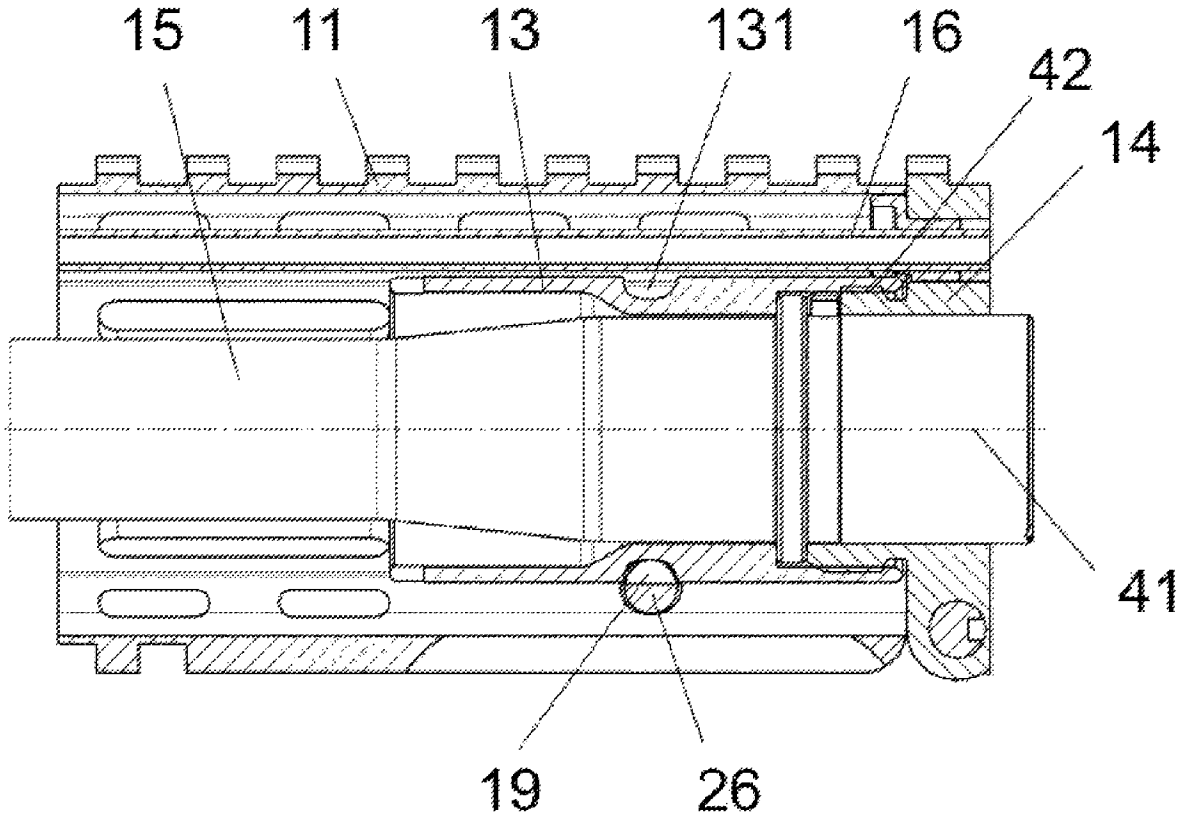
FIG. 2 is a sectional view of the handguard of the disclosure along the plane II-II of FIG. 1, in combination with the barrel and barrel nut of a firearm.

FIG. 2 shows the cut II-II of FIG. 1, an axial section through the handguard housing axis (or shaft axis) 41, thus parallel to the barrel axis. The barrel 15 is radially closest to the barrel axis (parallel or coinciding with the housing axis 41); a travelling barrel nut 13 in the form of an elongated sleeve may be pushed onto it and connected at its rear end to the upper housing 14 by means of a screw joint 42. This presses a collar of the barrel 15 through a rear face of the travelling nut 13 against a front face of the upper housing 14, thus holding the barrel 15 itself. The housing 11 of the handguard 1 encloses not only the barrel 15 together with the barrel nut 13, but also a gas pipe 16.

An annular groove 131 is provided in the travelling nut 13; the lever 21 partly lies in this annular groove and in this illustration is cut in the area of its center element 26. A long hole running in the transverse direction 52 is provided in the housing 11, whose cross section has circular end sections, and two parallel long hole axes 191, 192 running in the transverse direction 52. These axes lie in a plane normal to the vertical 52.

Figure 3A:
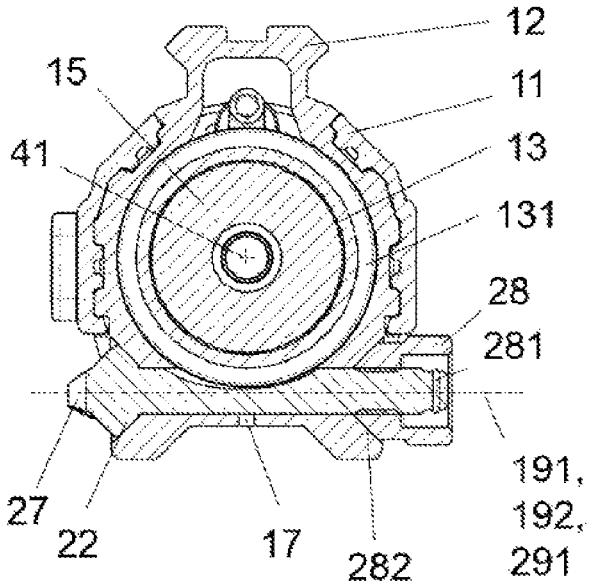
FIGS. 3A and 3B is a sectional view of the handguard of FIG. 2 along the plane III-III of FIG. 1 showing two different clamping configurations.
Figure 3B:
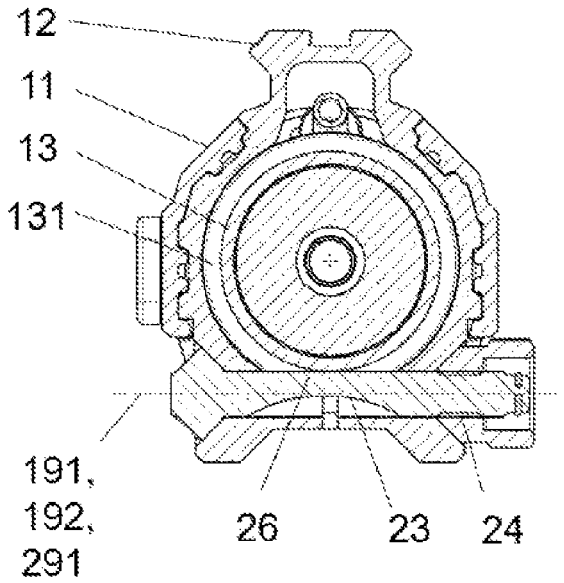

FIGS. 3A and 3B are a cut along the line III-III of FIG. 1, thus normal to the housing axis 41, and represent two different clamping situations.

The structure itself is as follows: The lever 21 is pushed with its threaded end forward through the long hole 19, the nut 28 with its conical nut section 282 directed towards the weapon, screwed on and secured against loss by means of the spring-loaded safety ring 281. By screwing on the nut 28, a longitudinal slit 17 of the housing 11 or the spacer 12 in the area of the lever 21 is changed in its width and provides for pretensioning and adjustment with the conical sections 22 of the shaft and 282 of the nut.

FIG. 3A shows the released position in which the center element recess 23 is directed towards the housing axis 41 and allows longitudinal movement of the housing 11 along the barrel and the barrel nut 128 (if the nut 28 is not screwed on too tightly), as the contour in the area of the recess 23 of the center element 26 lies radially outside the contour of the barrel nut. When the rear end position (FIG. 2) is reached when the housing is pushed on, the lever arm 27 is rotated 180° about the lever axis 291, if necessary after tightening the nut 28, whereby the shaft with its untapered surface area enters the ring groove 131 of the barrel nut 13. The positions and geometries of the shaft are important in this process. As a result of the positions and the geometries of the annular groove 131 of the barrel nut 13,
of the long hole 19 of the housing 11 and
of the shaft of the lever 21, the housing 11 is pulled in the direction 51 of the housing axis 41 towards the upper housing 14 and by the (previous or further) tightening of the nut 28 with a narrowing slot 17, an increasing clamping in the circumferential direction—i.e. tangential to the barrel 15—is affected.

Figure 4B:
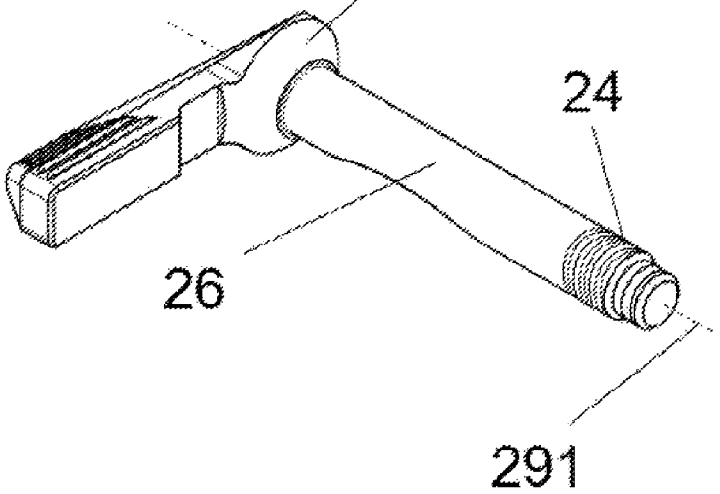
FIGS. 4A and 4B depict an illustrative lever for the handguard of the present disclosure in two different perspective views.
Figure 4A:
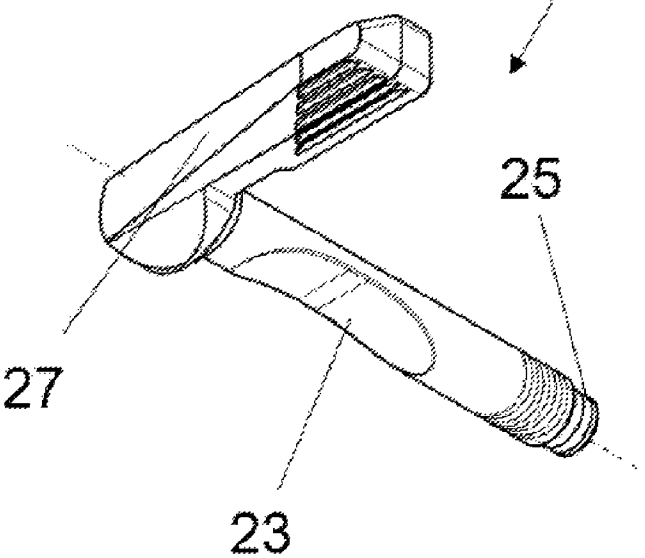

The clamping device 2 shown in detail in FIGS. 4A and 4B is comprised of a lever 21 having a shaft with a lever axis 291, in one end portion of which a thread 24 is provided and at the other end of which a lever arm 27 protrudes approximately at a right angle. In this end portion the diameter of the shaft increases conically to the lever arm 27 and forms a conical shaft section 22. The shaft has a recess 23 in the center element 26, approximately in the middle, which forms a generally cylindrical, preferably circular cylindrical, surface; the generators of the surface run parallel to the plane defined by the lever axis and the lever arm 27 in the exemplary embodiment. These figures also show that the thread 24 does not extend to the end of the shaft, but ends at an annular groove 25 whose inner diameter is smaller than the diameter of the base of the thread. The shaft diameter in the direct end portion is greater than that of the groove, but smaller than that of the base of the thread.

Figure 5A:
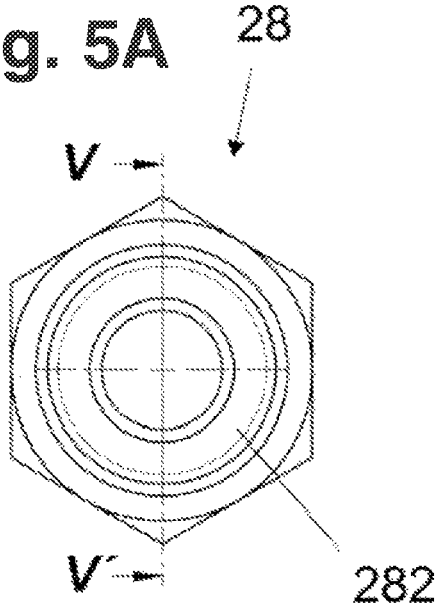
FIGS. 5A-5C provide differing views of an illustrative nut for the handguard of the present disclosure.
Figure 5B:
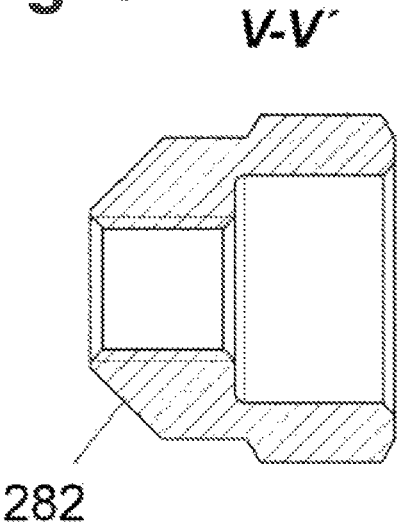
Figure 5C:
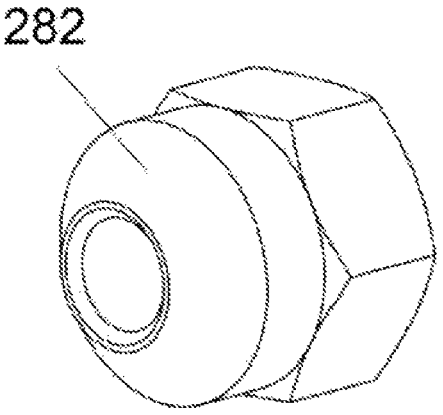

A nut 28, shown in FIGS. 5A-5C, interacts with the thread 24 of the shaft. This nut 28 is provided in a first axial area with an internal thread, which can interact with the thread 24; in a second axial area it has a cylindrical bore (recess)

with a larger diameter than the shaft diameter. This recess extends over the entire remaining length (actually height) of the nut 28. In the first axial area, the outer contour of the nut is cylindrical with subsequent conical taper towards the end, in the second an external hexagon is provided.

By rotating the lever arm 27 in the mounting position (see FIGS. 3 and 7), the center element 26 in conjunction with the annular groove 131 secures the handguard 1 against axial displacement. A special feature is the design of the conical shaft section 22 on the shaft of the lever 21 and the conical nut section 282 on the nut 28 in conjunction with the two corresponding clamping surfaces 18 of the handguard 1. This double conical design results in self-centering clamping when the nut 28 is tightened to the locking position after the lever 2 has been turned.

Figure 6A:
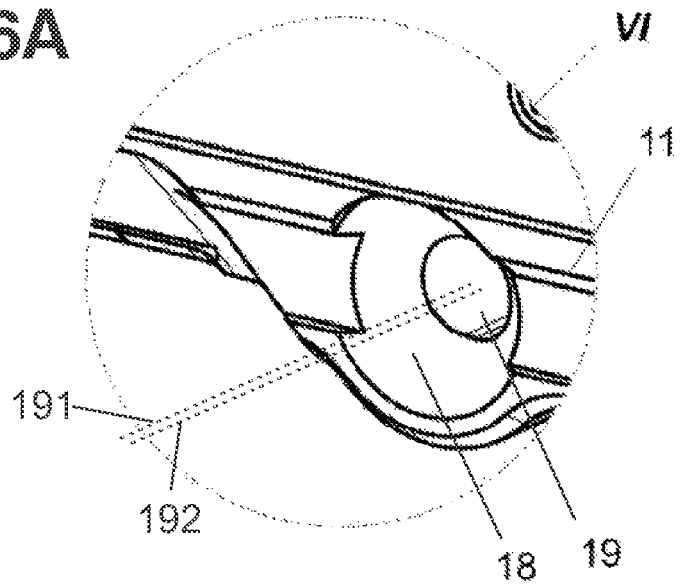
FIGS. 6A and 6B provide different views of a detail of the handguard of the present disclosure.
Figure 6B:
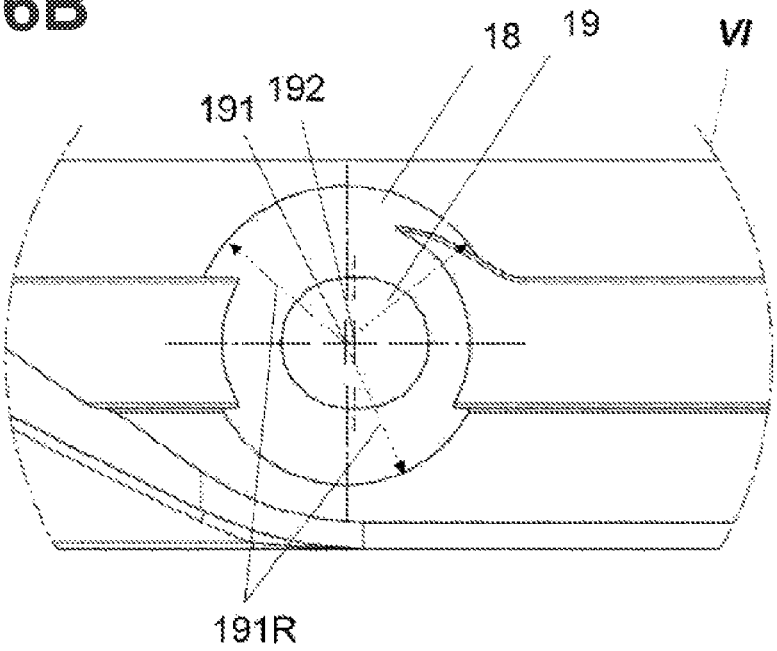

An equally important aspect of the handguard of the present disclosure in terms of its design is the formation of the long hole 19 shown in detail in FIGS. 6A and 6B, which, as already mentioned, has two parallel long hole axes 191, 192. In addition, there is the preferably concentric conical clamping taper surface 18 (on both sides of the handguard 1), which is centric about the axis 191 and leads to a displacement and/or application of force to the handguard against the barrel direction, towards the upper housing 14, when a tangential force is applied about the lever axis 291, which enables axial fixing and thus fixation in addition to tangential fixing.

The assembly is carried out with the lever 21 in the "OPEN" position up to the stop on the "Upper," then the nut 28 is tightened, narrows the gap 17 and thus fixes the housing 5 to the travelling nut 128. This situation is essentially illustrated in FIGS. 7A-7C. The first long hole axis 191 is further away from the upper housing 14 than the second long hole axis 192.

Figure 7A:
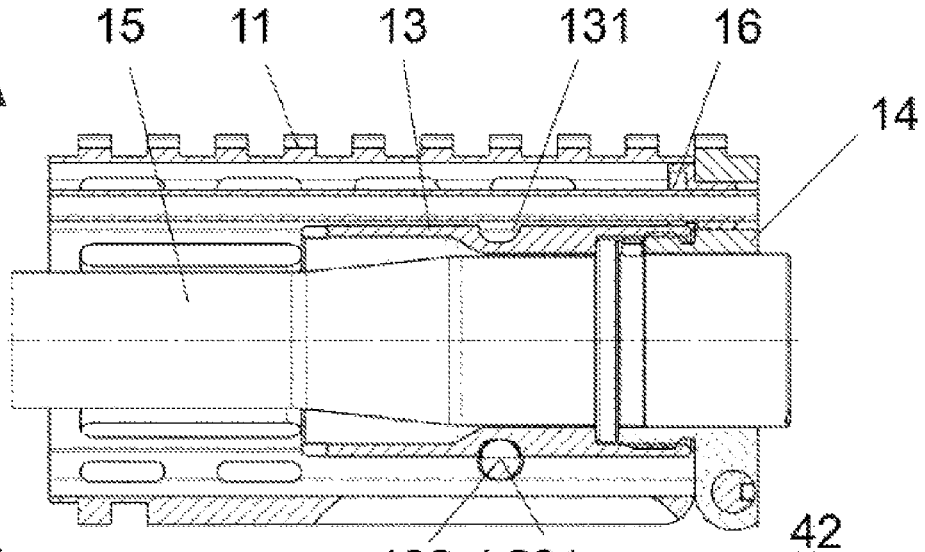
FIGS. 7A-7C provide sectional views along the different clamping situations in an axial cut.

In FIG. 7A, the housing 11 with the clamping device 2 is placed in the "OPEN" position; the lever axis 291 is at a distance from the second long hole axis 192 and is closer to the upper housing than the latter.

Figure 7B:
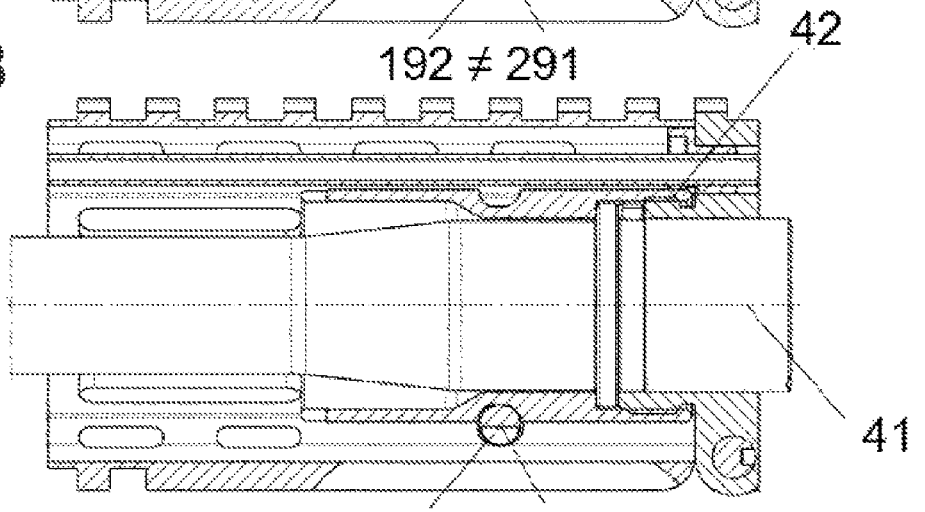

FIG. 7B shows the situation when rotating the lever 21 into the "LOCKED" position; the two axes have come together much closer and can also coincide.

Figure 7C:
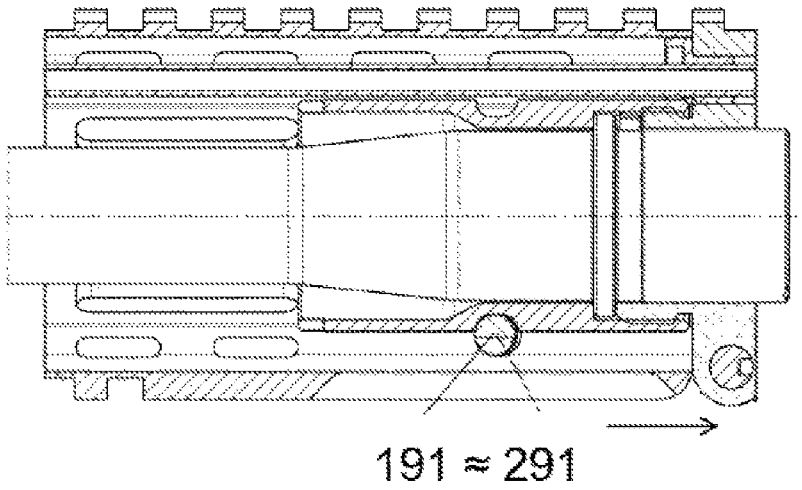

FIG. 7C shows the situation after tightening the clamping nut 28, since the conical clamping taper surface 18 around the axis 191, as indicated by the arrow, causes a load/displacement of the housing 11 of the handguard 1 in the direction of the upper housing 14, so that stable mechanical conditions prevail.

Thus, the disclosed handguard allows tangential and axial clamping of the handguard at the same time.

In the exemplary embodiment shown, the outer diameter of the nut 28 is selected so that a part of the weapon, preferably the bolt carrier (not shown), can be used to loosen the nut 28. This means that the bolt carrier 28 with its slit-shaped opening, which allows the hammer or striking piece to pass through, can be used to unscrew the nut 28. A "half inch" width of the nut head is therefore particularly preferred.

Further embodiments concern the loss protection of the clamping device, already explained, by the annular groove 25 on the lever 21 in conjunction with the safety ring 281, which reduces the risk of the nut completely unscrewing and thereby decreases the risk of loss.

A person having ordinary skill in the art with the benefit of the present disclosure could readily modify the embodiments disclosed herein to other types of rifles and firearms without extensive or complex testing. The materials to be used are the same as in the prior art; the processing or the manufacturing processes to be chosen are also the same.

In the description and in the claims, the terms "front," "back," "top," "bottom" and so on are used in the common form and with reference to the object in its usual position of use. This means that in a weapon the muzzle of the barrel is "in front," that the lock or sled is moved "back" by the explosive gases, etc. Transverse to a direction means substantially a direction turned by 90° to it, unless otherwise indicated. Special reference is made to the various coordinate systems 51—barrel direction, 52—transverse direction and 53—vertical (with the weapon in the stop position as usual), drawn and described in the figures for better orientation.

It should also be noted that in the description and in the claims, indications such as "lower area" of an object means the lower half and in particular the lower quarter of the total height, "lowest area" the lowest quarter and in particular an even smaller part, while "center area" means the middle third of the total height (width-length). All these indications have their common meaning, applied to the intended position of the object under consideration, unless otherwise indicated.

In the description and in the claims "substantially" means a deviation of up to 10% of the indicated value, if it is physically possible, both downward and upward, otherwise only in the meaningful direction; with degrees (angle and temperature) this means±10°.

All quantities and percentages, in particular those used to delimit the scope of the disclosed handguard, as far as they do not concern the concrete examples, are to be understood with a tolerance of ±10%, thus for example 11% means from 9.9% to 12.1%. In the case of designations as in the case of "a solvent," the word "a" is not to be regarded as a numerical word, but as an indefinite article or as a pronoun, unless the context indicates otherwise.

Unless otherwise indicated, the term "combination" or "combinations" stands for all types of combinations, from two of the components concerned to a plurality or all of such components; the term "containing" also stands for "comprising".

The features and variants indicated in the individual embodiments and examples may be freely combined with those of the other examples and embodiments and, in particular, used to identify the invention in the claims without necessarily taking along the other details of the respective embodiment or respective example.

| | | | |
|---|---|---|---|
| 1 | Handguard | 41 | Housing axis |
| 11 | Handguard housing (handguard) | 42 | Screw joint |
| 12 | Spacer | | |
| 13 | Barrel nut (travelling nut) | 51 | Barrel direction |
| 131 | Barrel nut (channel) | 52 | Transverse direction |
| 14 | Upper housing | 53 | Vertical direction |
| 15 | Barrel | | |
| 16 | Gas pipe | | |
| 17 | Slit | | |
| 18 | Conical clamp taper surfaces | | |
| 19 | Long hole | | |
| 191 | First long hole axis | | |
| 192 | Second long hole axis | | |
| 2 | Clamping device | | |
| 21 | Lever | | |
| 22 | Conical shaft section (Clamp taper) | | |
| 23 | Recess (center element) | | |
| 24 | Thread | | |
| 25 | Annular groove | | |
| 26 | Center element | | |
| 27 | Lever arm | | |

-continued

| | |
|---|---|
| 291 | Lever axis |
| 28 | Nut |
| 281 | Safety ring |
| 282 | Conical nut section |

The invention claimed is:

1. A handguard for mounting on a barrel or a barrel nut of an existing firearm, where the barrel or barrel nut has an annular groove, the handguard comprising:

a handguard housing having a housing axis, the handguard housing defining a slit running radially thereto, and further defining a through-opening running in a transverse direction, where the through-opening is a long hole having an outline comprised of two semicircles with a first axis and a second axis parallel to the first axis, with a rectangle located in-between; and a clamping device for mounting in the through-opening of the handguard housing, the clamping device having a lever that defines a lever axis and that includes:

a center element having a recess in a center area of the center element, the center element extending along and surrounding the lever axis and having a threaded section at a first end portion and a lever arm at a second end portion, where a conical shaft section is provided at the second end portion that widens towards the lever arm and is configured to contact a corresponding conical clamping surface of the handguard housing; and a nut having an internal thread that matches the threaded section of the first end portion of the center element;

such that when the handguard is in its assembled state, the lever is disposed in the through-opening of the handguard housing in a plane normal to the handguard axis, the nut is screwed onto the threaded section thereby narrowing the slit, and an angular position of the lever about the lever axis is such that the center element contacts the annular groove of the barrel or barrel nut.

2. The handguard according to claim 1, wherein:

the center element is further provided with an annular groove at its first end portion;

the nut includes the internal thread in a first axial section of the nut, the first axial section being provided with a conical nut section on an outer surface, and a bore with a larger diameter than the internal thread in the first axial section is formed in a second axial section, and a safety ring is inserted into the annular groove of the first end portion.

3. The handguard according to claim 2, wherein the long hole of the handguard housing includes a conical clamp taper surface at each end of the long hole, each conical clamp taper surface being centrally formed about the first axis of the through-opening outline and the conical clamp taper surfaces being configured to cooperate with the conical shaft section and the conical nut section, respectively.

* * * * *